United States Patent [19]

Miller

[11] 4,289,076

[45] Sep. 15, 1981

[54] SELF ALIGNING CARRIER HEAD AND TRUCK ASSEMBLY

[76] Inventor: John F. Miller, P.O. Box 277, Howell, Mich. 48843

[21] Appl. No.: 43,376

[22] Filed: May 29, 1979

[51] Int. Cl.[3] ..... B61D 15/00; B61F 13/00; B66C 17/04

[52] U.S. Cl. ..... 105/163 R; 104/89; 104/95; 105/148; 105/154; 212/209; 212/210

[58] Field of Search ..... 105/148, 154, 155, 163 R, 105/163 SK; 104/89, 91, 94, 95; 212/18, 19, 205, 209, 210; 308/3 R

[56] References Cited

U.S. PATENT DOCUMENTS

| | | | |
|---|---|---|---|
| 1,572,941 | 2/1926 | McBride | 105/154 |
| 1,752,026 | 3/1930 | Phillips | 105/163 R |
| 2,080,180 | 5/1937 | Messier | 105/171 |
| 2,861,522 | 11/1958 | Rossell | 105/171 |
| 2,884,871 | 5/1959 | Mazzola et al. | 105/148 |
| 3,190,236 | 6/1965 | Leach | 105/155 |
| 3,541,962 | 11/1970 | Avery | 104/94 X |
| 3,604,567 | 9/1971 | Tanaka | 212/18 |
| 3,645,210 | 2/1972 | Tanaka | 105/163 R |
| 3,707,125 | 12/1972 | Milenkovic et al. | 105/179 |
| 3,927,910 | 12/1975 | Fagel | 295/36 R |
| 4,133,434 | 1/1979 | Chierici | 308/3 R X |

*Primary Examiner*—Randolph A. Reese

*Attorney, Agent, or Firm*—Burton, Parker & Schramm

[57] ABSTRACT

A carrier head which rides a rail is provided such that when connected by a load carrying member to a second carrier head on a second rail lateral movement is facilitated between the carriers to adjust for differences in distance between the rails. The carrier head has a surface for bearing the load while a pin positioned above the load supporting surface passes through a load bearing connector which permits movement of the load longitudinally.

9 Claims, 4 Drawing Figures

SELF ALIGNING CARRIER HEAD AND TRUCK ASSEMBLY

BACKGROUND OF THE INVENTION

When using bridge cranes it is a practice to suspend them from two or more parallel runway rails. This is accomplished by constructing the bridge crane in a rigid I-shaped pattern. At the points of the I are pairs of carrier heads which hang from the runway rails and are rigidly connected to one another by side beams. Each side beam is in turn rigidly connected to the other by a bridge beam on which is hung a trolley for supporting a load. The carrier heads all have flanges on the wheels or side thrust rollers designed to keep the wheel on the runway rails. This I-shaped structure runs well so long as the rails are correctly hung. In practice, however, it is practically impossible to align the runway stands exactly parallel. Thus there are created variations in the distance between the runway stands. Normally the variation can be kept to a point where the trolley will travel on this runway stand without binding. The variations create pressure against the members designed to keep the carrier heads on the rails and lead to their early failure. Since the bridge cranes are suspended large distances above the floor, the maintenance cost of frequent replacement becomes significant. In addition lost production time results whenever such replacement is required. The invention allows the trolley assembly to remain in line with the runway rails without side pressures, despite deviations from a parallel relationship of those rails.

SUMMARY OF THE INVENTION

This invention is directed towards a carrier head for riding rails which is joined to a second carrier head by a connector which bears the load. The carrier head has wheels for riding the rail which are rotatably joined to a carrier body. The carrier body has a surface on which the connector rests and over which the connector may move. Parallel to the wheels restraining means are provided which allow the connector to move laterally but prohibit any substantial longitudinal movement between the connector and the body. In this way, when there is a lateral irregularity in the rail on which the carrier head is moving, the carrier head may follow the irregularity so that the forces on the wheels and restraining means are insignificant while the connector maintains its longitudinal relationship to the second carrier head by moving along the support surface on the restraining means.

The invention also covers a trolley assembly where there may be lateral movement between carrier heads and the trolley assembly while the carrier heads continue to move longitudinally together.

DESCRIPTION OF PREFERRED EMBODIMENT

Figure 1:
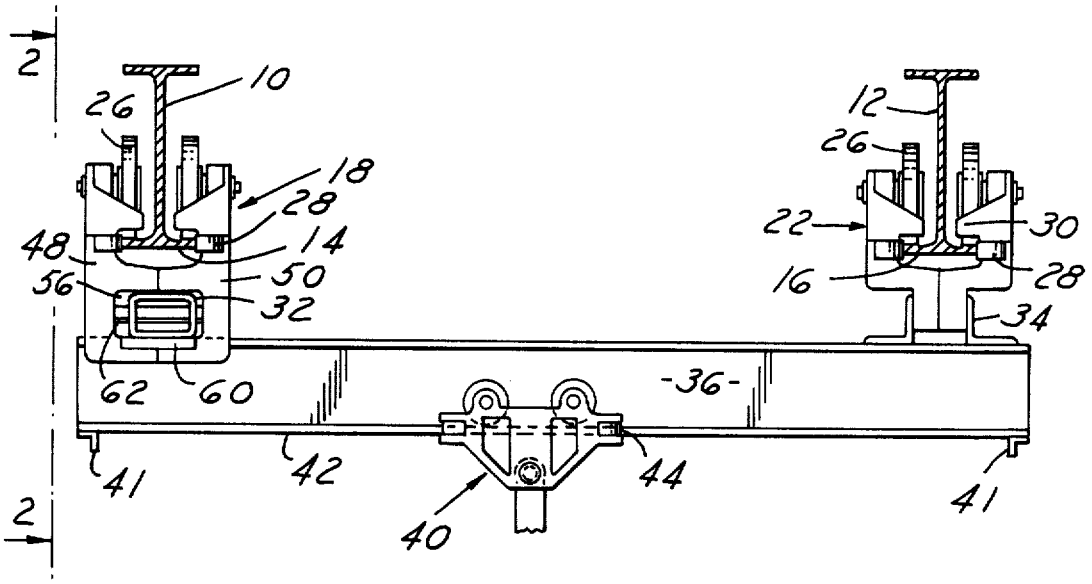
FIG. 1 is a front view with the rail cut away of a trolley assembly embodying the invention.
Figure 2:
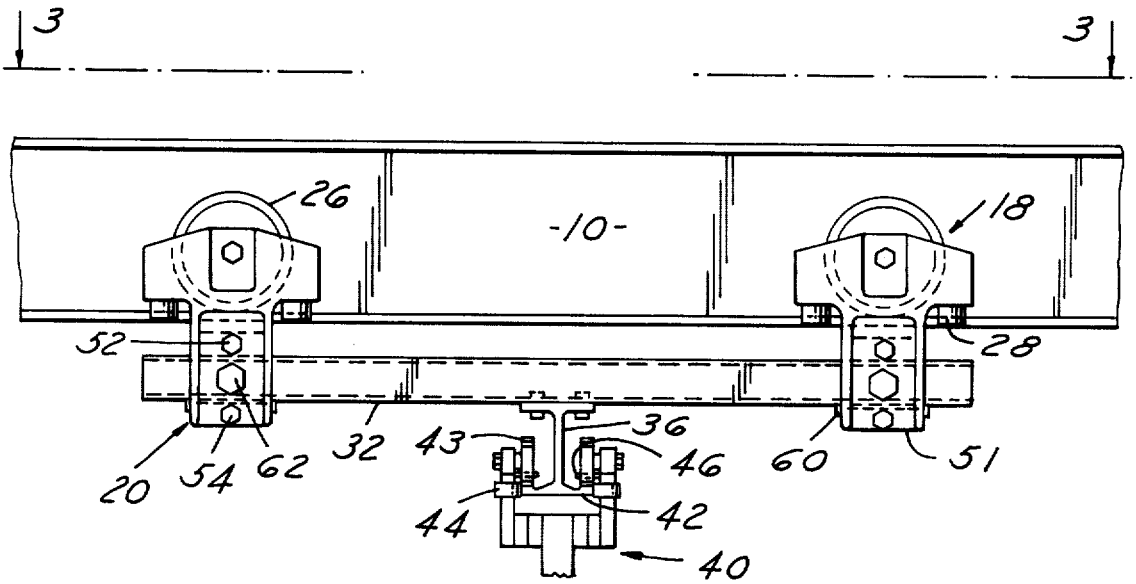
FIG. 2 is a side view of the assembly.
Figure 3:
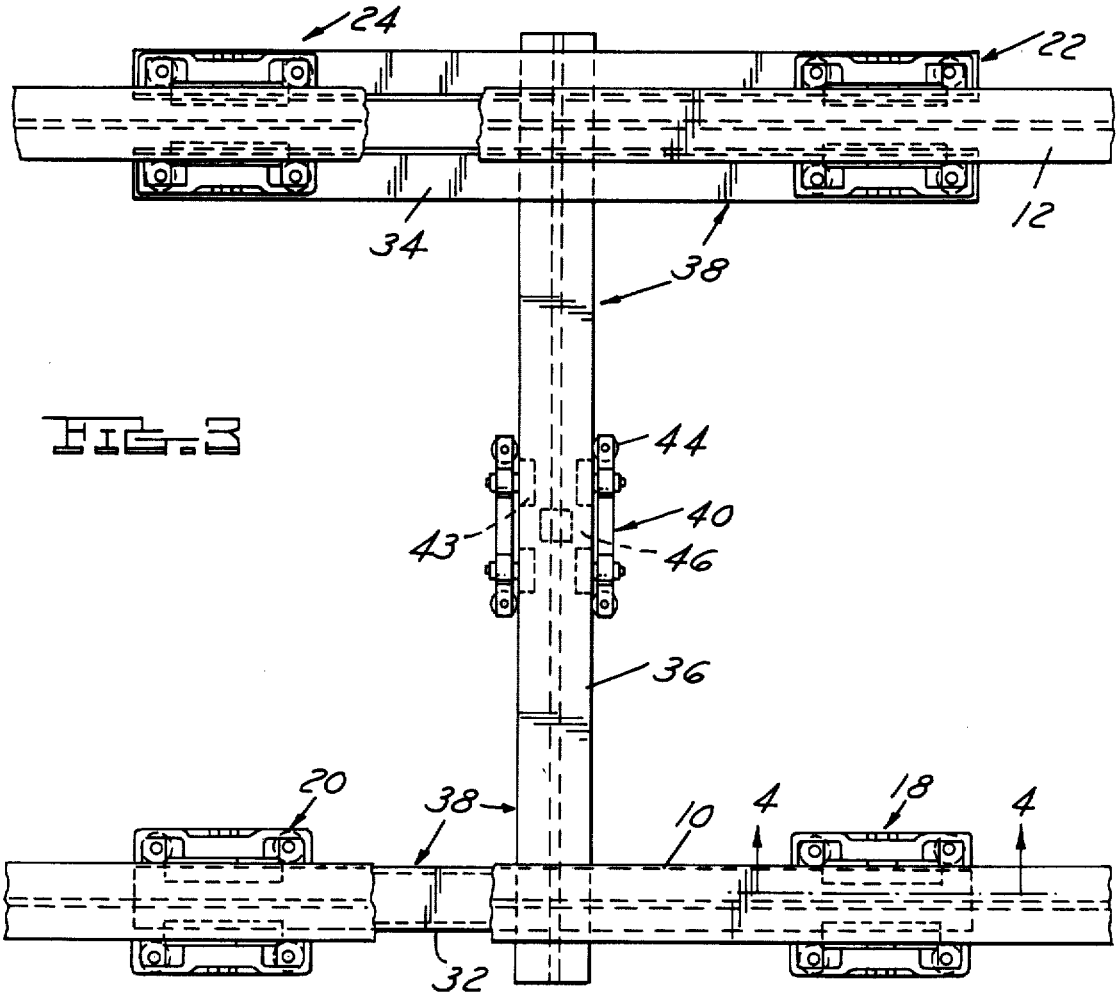
FIG. 3 is a top view of the assembly with the rail partially cut away to show additional details of the assembly.
Figure 4:
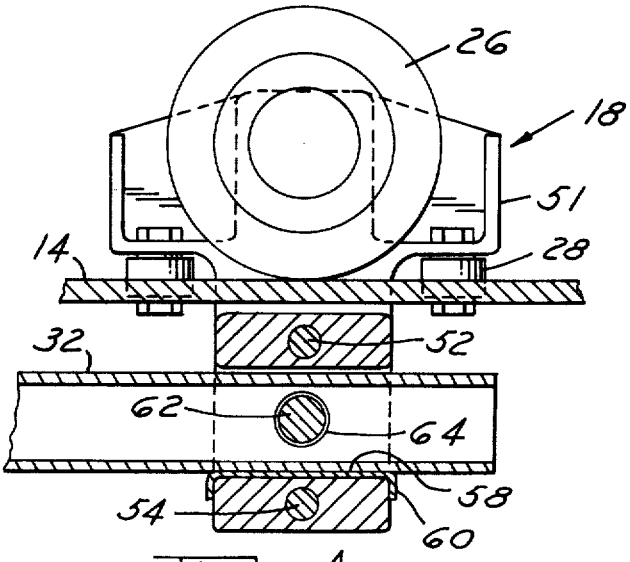
FIG. 4 is a partial cross section of a carrier head of the assembly taken along lines 4—4 of FIG. 3.

The trolley assembly used to describe my invention will be in the form of a bridge crane, though other trolley assemblies can make use of this invention. The bridge crane allows movement of a load both laterally and longitudinally with respect to a pair of rails 10 and 12 while supporting major loads of a ton or more. These rails, or runway spans as they are often called, take the form of I-beams suspended from a ceiling. The bridge crane rides on the lower flanges 14, 16 of these rails. This is accomplished by means of two pairs of trolleys or carrier heads 18, 20, 22, 24. The carrier heads each include a pair of wheels 26 which ride atop the flanges. To prevent the wheels from falling over the edge of the flange, there are generally included lateral support retaining means 28. In this embodiment the support retaining means consist of rollers moving along the edge of the flanges. One alternative form of retaining means is the use of flange wheels. Flange wheels would be substituted in place of wheels 26 with the flange on the outer part of the wheel along the edge of the rail flange. Thus sideway movement of a trolley would cause one of the wheel's flanges to contact the rail and prevent any additional sideway movement, just as the rollers shown in this embodiment accomplish the same thing. All of the carrier heads riding the rails include cast safety lugs 30. These lugs are a safety feature so that if the wheel should fail for some reason the carrier head would not drop from the rail but rather the safety lug would catch on the lower flange of the rail, preventing the trolley assembly from falling onto the floor below. Each pair of carrier heads are joined by members 32, 34. These members in turn are joined together by a load bearing span 36. The rigid joining of these members and the load bearing span creates a giant I-shaped member 38 when viewed from the top as in FIG. 3. This load bearing connector is moved along the rail to provide longitudinal movement to any load carried. Lateral movement of the load is provided by a load bearing trolley 40 which rides on the lower flange 42 of the I-beam forming the load bearing span 36 between stops 41. This trolley has wheels 43 and rollers 44 providing the same function as those on the other carrier heads. Instead of the cast safety lugs, however, a safety clevis 46 is provided which performs the same function.

In the past all of the carrier heads riding the runway rails would be rigidly joined to members 32 and 34. Thus to allow longitudinal travel, the rails would have to be aligned parallel to one another. This could be done with sufficient accuracy to prevent binding of the trolley assembly as it moved, however exact parallel alignment is generally not possible in field conditions. Where variations from the parallel alignment existed, forces would be applied against lateral support retaining means 28 which could cause them to fail.

To overcome the problem of inexact parallel placement of the rails, the trolley assembly of this invention was developed so to allow lateral movement of the carrier heads or trolley on one rail with respect to the other, while keeping the carrier head longitudinally aligned and while providing the necessary support for the load. This was accomplished by, instead of joining both pairs of carrier heads rigidly to the load bearing connector, as was done with carrier heads 22, 24, at least one pair 18, 20 is operably joined to allow lateral movement. These carrier heads 18, 20 are self aligning, as will be explained below. Each self aligning carrier head has a body 51 made of two parts, 48 and 50. When these are joined by two bolts 52 and 54, an opening 56 through the carrier body is formed. The lower surface of this opening will form a load supporting surface 58 on which member 32 of the load bearing connector rests. Since it is intended that the tube 32 be able to move easily over the surface, a brass wear plate 60 is included as part of the load supporting surface 58. This wear plate is well lubricated to ease the movement of the load bearing connector. To prevent the tube from moving longitudinally through this opening a self aligning pin 62 passes through the body 51 of the carrier head and through the opening. This pin will be aligned parallel to the axis of wheels of its carrier head 18 and has a free length on which the tube may move substantially greater than the length of the tube. A hole or recess 64 is made in the tube 32 at a distance above the lower surface of the tube, so that when the pin passes through the hole 64 the lower surface of the tube rests upon the load supporting surface 58. This hole 64 for the pin is made parallel to the axis of wheels of the other carrier heads. Thus, no downward substantial forces are placed upon the pin. The hole is made slightly larger than the pin so to allow easy movement of the tube along the pin without binding. Thus in operation if merely lateral movement of the load is required, the tube rests on the load bearing surface to support the weight of the load while trolley 40 moves the load. If, however, longitudinal movement of the load is required, the trolley assembly is moved along the rails with one pair of carrier heads 22, 24 being moved due to their rigid connection to member 34. The self aligning carrier heads 18, 20 move with the trolley assembly longitudinally by means of pin 62. If during this movement the distance between the rails varies, the tube slips on the pin along the load bearing surface to account for the differences between the rails. In this way the wheels are kept on the rails without unusual forces bearing against the rollers.

What is claimed is:

1. A trolley assembly riding a pair of rails comprising in combination:

a first carrier head with a first wheel for riding the first rail of said pair, the first carrier head joined to a load bearing connector upon which a load may be carried;

a second carrier head with a second wheel riding on the second rail of said pair operably joined to the load bearing connector by a non-movable restraining means for restraining longitudinal movement between the load bearing connector and the second carrier head, and said restraining means passing through a stationary recess in the load bearing connector and having a free length greater than the length of the recess to allow unresisted lateral movement relative the carrier head of the load bearing connector along the restraining means; and said second carrier head further having separate from the restraining means a connecting support surface on which a lower surface of the load bearing connector rests in continual surface to surface contact.

2. The trolley assembly of claim 1 wherein the carrier support surface is a flat surface lying below the restraining means so that when the restraining means pass through the recess the lower surface of the connector slidably rests on said flat surface.

3. The trolley assembly of claim 2 wherein the load bearing connector comprises a rectangular tube, the lower surface comprises the bottom of the tube and the recess is formed by holes in each of the sides of the tube.

4. The trolley assembly of claim 3 wherein the restraining means comprise a pin.

5. The trolley assembly of claim 1 wherein the restraining means lie parallel the axis of the second wheel and the recess lies parallel the axis of the first wheel.

6. A carrier head for riding along a rail and for operably joining to a second carrier head by a load bearing connector with a recess comprising in combination:

wheel means for riding said rail;

a carrier body to which said wheel means is rotatably joined, said carrier body comprising non-moving restraining means for restraining lateral movement between the connector and the body, said restraining means of a length greater than the recess in the load bearing connector and allowing unresisted lateral movement of the carrier body relative the connector by movement of the connector along the restraining means; and said carrier body further having separate from the restraining means a connector support surface on which a lower surface of the load bearing connector rests in continual surface to surface contact when the restraining means pass through the recess.

7. The carrier head of claim 6, wherein the carrier body has a hole passing therethrough, said connector support surface comprising a flat lower surface of the hole.

8. The carrier head of claim 6 wherein the restraining means comprise a pin parallel to the axis of the wheel means.

9. The carrier head of claim 6 wherein the connector support surface comprises a wear plate.

* * * * *